US010918211B2

(12) United States Patent
Sugano et al.

(10) Patent No.: US 10,918,211 B2
(45) Date of Patent: Feb. 16, 2021

(54) CHAIR AND SEAT SUPPORT MECHANISM

(71) Applicant: KOKUYO CO., LTD., Osaka (JP)

(72) Inventors: Takao Sugano, Osaka (JP); Yasuhiro Shibamoto, Osaka (JP); Fei Xu, Osaka (JP); Toshiki Yajima, Osaka (JP); Katsuaki Hayashi, Osaka (JP)

(73) Assignee: KOKUYO CO., LTD., Osaka (JP)

( * ) Notice: Subject to any disclaimer, the term of this patent is extended or adjusted under 35 U.S.C. 154(b) by 159 days.

(21) Appl. No.: 16/305,248

(22) PCT Filed: Jun. 20, 2016

(86) PCT No.: PCT/JP2016/068299
§ 371 (c)(1),
(2) Date: Nov. 28, 2018

(87) PCT Pub. No.: WO2017/221312
PCT Pub. Date: Dec. 28, 2017

(65) Prior Publication Data
US 2020/0315352 A1 Oct. 8, 2020

(51) Int. Cl.
*A47C 3/025* (2006.01)
*A47C 3/18* (2006.01)
(Continued)

(52) U.S. Cl.
CPC ..... *A47C 3/025* (2013.01); *A47C 3/0255* (2013.01); *A47C 3/0257* (2013.01); *A47C 3/185* (2013.01); *A47C 9/002* (2013.01); *A47C 3/026* (2013.01)

(58) Field of Classification Search
CPC ..... A47C 3/0257; A47C 3/0255; A47C 3/025; A47C 3/185; A47C 3/026; A47C 3/18; A47C 9/002
(Continued)

(56) References Cited

U.S. PATENT DOCUMENTS 4,099,697 A * 7/1978 Von Schuckmann ..... A47C 3/026 248/398
4,948,198 A * 8/1990 Crossman ..... A47C 3/026 297/302.4
(Continued)

FOREIGN PATENT DOCUMENTS

GB 189817474 A 10/1898
JP 62-64313 A 3/1987
(Continued)

OTHER PUBLICATIONS

International Search Report dated Sep. 27, 2016, issued in counterpart International Application No. PCT/JP2016/068299 (2 pages).
(Continued)

*Primary Examiner* — Mark R Wendell
(74) *Attorney, Agent, or Firm* — Westerman, Hattori, Daniels & Adrian, LLC

(57) ABSTRACT

A chair comprises: a leg 1 erected on a floor surface; a seat 3 arranged above the leg 1; and a support mechanism 8 interposed between the leg 1 and the seat 3, wherein the support mechanism 8 is arranged below the seat 3 and is configured to movably support the seat 3 along a predetermined trajectory by having an omnidirectional connection unit 72 configured to operably connect in all directions including the front-rear direction and the left-right direction, comprises: a seat inclining function configured to downwardly incline a tip side in a movement direction of the seat 3, and further comprises: a return-force generation mechanism configured to generate, by elevating a center of gravity of the seat 3, a return force in a direction of returning the seat 3 to the reference position.

20 Claims, 9 Drawing Sheets

(51) Int. Cl.
*A47C 9/00* (2006.01)
*A47C 3/026* (2006.01)

(58) Field of Classification Search
USPC ..... 297/258.1, 261.1
See application file for complete search history.

(56) References Cited

U.S. PATENT DOCUMENTS 5,590,930 A * 1/1997 Glockl ..... A47C 3/0257 297/258.1
7,100,983 B1 * 9/2006 Gant ..... A47C 3/025 108/2
2005/0116519 A1 * 6/2005 Wullum ..... A47C 3/026 297/339
2009/0261642 A1 * 10/2009 Dickie ..... A47C 7/14 297/314
2011/0089733 A1 * 4/2011 Nishino ..... A47C 3/0257 297/258.1
2012/0286554 A1 * 11/2012 Moon ..... A47C 3/18 297/344.21
2013/0229040 A1 * 9/2013 Mountz ..... A47D 9/02 297/260.2
2019/0045928 A1 * 2/2019 Yajima ..... A47C 1/024

FOREIGN PATENT DOCUMENTS

JP 1-291809 A 11/1989
JP 10-513374 A 12/1998
JP 2012-10938 A 1/2012
KR 101 203 255 B1 11/2012
KR 101 267 804 B1 5/2013
WO 2007/010618 A 1/2007

OTHER PUBLICATIONS

Office Action dated Mar. 31, 2020, issued in counterpart JP Application No. 2018-523182, with English Translation. (9 pages).
Extended Search Report dated Mar. 9, 2020, issued in counterpart EP Application No. 16906231.2 (24 pages).
Office Action dated Jun. 5, 2020, issued in counterpart CA Application No. 3,025,252. (3 pages).
Office Action dated Dec. 2, 2020, issued in counterpart EP Application No. 16 906 231.2. (5 pages).

* cited by examiner

CHAIR AND SEAT SUPPORT MECHANISM

TECHNICAL FIELD

The present invention relates to a chair suitably applicable to an office rotating chair and the like.

BACKGROUND ART

Conventionally, chairs, especially office rotating chairs, with an aim that a seated person can maintain a comfortable sitting posture for a long time in an office, at home or the like, have been widely devised (for example, see Patent Document 1).

These office rotating chairs are configured so that a seat and a backrest can be tilted in accordance mainly with a rearward inclining and forward inclining movement of the seated person and are configured so that the seat and the backrest can be fixed in a position allowing for realization of a required posture of the seated person, so that an operation allowing the seated person to feel comfort while proceeding a work is possible.

Even though, from an outside perspective, it may appear as if a seated person sitting on an office rotating chair for a long time normally rests in a posture in which the person feels comfort, it has become clear that the person actually moves a lumbar region, a gluteal region and further femoral region from the required posture all the time to maintain a comfortable sitting posture on the office rotating chair.

Specifically, even though many seated persons appear, at first glance, to rest in a sitting posture that is comfortable for the persons, it has been seen that the persons actually maintain comfort by the persons' own sitting, while moving, in any direction, that is, in a front-rear direction and a left-right direction with respect to the planar direction, a position of the lumbar region and the gluteal region as the center in planar view, in a posture that is generally comfortable. Additionally, it has become evident that in a state in which such an operation can be performed smoothly, the seated persons feel no discomfort, and further, the state contributes to improving efficiency of work to be done during sitting.

Therefore, it should be understood that present chairs are required to be equipped with a function that allows for a suitable support for the above-described behavior by the seated persons.

However, in a support mechanism according to Patent Document 1, an operation direction of the seat is limited to a front-rear direction and thus, as described above, even though the seated persons can move comfortably a position of the lumbar region and the gluteal region in a front-rear direction, the persons cannot move in a left-right direction at the same time. Therefore, it cannot be said that the support mechanism allows the above-described sitting posture that is comfortable for the persons to be sufficiently supported. Further, even if a support structure configured to operate in a left-right direction is added separately to a chair including the configuration, an operation direction of the seat is more strongly affected to the support structure either in a front-rear direction or in left-right direction. Therefore, it is considered that, in order to follow smoothly a desirable movement of the seated persons, a particular means is required.

Further, an example of chairs having a concept close to such a concept of the comfortable sitting posture as above described includes a chair including a seat support mechanism as mentioned in Patent Document 2.

CITATION LIST

Patent Literature

Patent Document 1: Japanese Unexamined Patent Application Publication No. 2012-010938

Patent Document 2: Japanese Unexamined Patent Application Publication (Translation of PCT Application) No. 10-513374

SUMMARY OF THE INVENTION

Problem to be Solved by the Invention

However, in the support mechanism of Patent Document 2, while a seated person moves a center of gravity to the front, rear, right, and left, a falling moment exerted on a supporting post further increases due to the seat pivoting around the lower end being a fulcrum, and thus, the seated person needs to brace his/her feet to the floor to rest in a proper posture. In addition, the same behavior is performed even when the seat is toppled in any direction of the front, rear, right, and left directions, and then the support mechanism may be suitable for a stool; however, in an office chair, a body movement of the seated person is usually different between the front and the rear, and the body movement of the seated person is also usually different between the front-rear and the left-right. Thus, it would be difficult to say that it is possible to provide supports properly corresponding to the body movement of the seated person.

Further, when the seated person braces his/her feet to the floor, if a lower end of a leg is supported by a caster, the caster may run in an unexpected direction, making a stable use of the chair difficult. In particular, the seat only performs a pivotal operation via the supporting post around the lower end being a fulcrum, and therefore, a seat pivotal trajectory is not accorded with a movement below the knees of the seated person, resulting in an undesirable support state in which the feet get stuck when the seat inclines forward.

Further, the support mechanism has a structure in which the supporting post descends and the lower end thereof comes in contact with the floor when the seated person sits down on the chair, and thus, there is inconvenience in that the seat sinks every time the persons sits down, leading to a problem that the floor can easily be damaged when the supporting post swings while being in contact with the floor.

An object of the present invention is to solve the problems described above, and in particular, by focusing on the movement that the seated person repeatedly moves the seat in all directions including the front-rear direction and the left-right direction while changing an initial posture from a reference position and supporting such a movement effortlessly in a natural manner, an object thereof is to provide a chair that allows for a proper support corresponding to a body movement of a seated person, allows for a stable use even in a subsequent posture reached to move the center of gravity, allows, as a result, the seated person to perceive a comfortable sitting feeling, even if sitting for a long time, and further allows the seated person to stably maintain a high work efficiency.

Means for Solving the Problem

The present invention adopts the following means in order to achieve such an object.

That is, a chair according to the present invention comprises: a leg erected on a floor surface; a seat arranged above the leg; and a support mechanism interposed between the leg and the seat, wherein the support mechanism is arranged below the seat and is configured to movably support the seat along a predetermined trajectory by having an omnidirectional connection unit configured to operably connect in all directions including the front-rear direction and the left-right direction, comprises: a seat inclining function configured to downwardly incline a tip side in a movement direction of the seat in accordance with movement of the seat from a predetermined reference position, and further comprises: a return-force generation mechanism configured to generate, by elevating a center of gravity of the seat in accordance with the operation of the seat from the reference position, in accordance with an amount of movement, a return force in a direction of returning the seat to the reference position.

That is, the inventors of the present application could contemplate the present invention by focusing for the first time on the following advantage that a seated person moves his/her lumbar region, gluteal region, and femoral region to the front, rear, right, and left by a predetermined dimension around a reference position being a center at which the seated person his/herself sits, and when the seat is inclined while the seat is moved horizontally during the movement and further, when the seat is operated so that a backswing force that causes the chair to return to the reference position is naturally obtained, as a result of which it is possible to improve the comfort of the seated person to make the seated person less exhausted while improving work efficiency.

Here, the "predetermined trajectory" indicates a trajectory along which a certain location of the seat can be continuously operated on an operation surface where a horizontal movement amount, a seat surface inclination angle, and an up-down movement amount are associated. A comprehensive example of the certain location includes a position of the center of gravity, but a position other than the center of gravity is also possible. In other words, in accordance with an operation of the seat along the predetermined trajectory, a unique up-down movement amount and seat surface inclination angle respectively determined by a position of the seat in planar view are set, and the seat will be repeatedly and continuously guided to these positions.

Further, "omnidirectional" in "the omnidirectional connection unit" means a configuration in that even if the seat is operated radially in planar view from a reference position or a predetermined arbitrary position, it can operate without being influenced in the front-rear direction and the left-right direction from a mechanism component of the chair or its shape.

Such a configuration not only can suitably maintain a posture of the seated person during sitting, but also can suitably support the movement of the seated person during sitting, specifically, the movement of the person such as moving repeatedly the seat from a reference position in all directions including the front-rear direction and the left-right direction, without being unnecessarily influenced in the mobile direction from predetermined operation direction having set to the chair or the shape of the mechanism component. Further, even if the seated person moves the center of gravity to the front, rear, right, and left, when the return-force generation mechanism configured to generate, in accordance with the amount of movement, the return force in the direction of returning to the reference position is applied, it is easy to design so that no large falling moment is exerted on a support mechanism, and thus, it is possible to reduce a need for the seated person to brace his/her feet to the floor to rest in a proper posture. Further, in this case, the generated return force changes in accordance with a body weight of the seated person, and thus, it is possible to obtain a suitable return force for the seated person. That is, a small return force is obtained for a light body weight and a great return force is obtained for a heavy body weight. Further, in particular, it is possible to provide a trajectory appropriate for movement of the seated person to move repeatedly the seat in all directions including the front-rear direction and the left-right direction from a reference position, and thus, a support state properly corresponding to the body movement of the seated person can be realized.

Further, it is not necessary for the seated person to brace his/her feet to the floor to assure balance, and even if a lower end of the leg is supported by a caster, a risk of the caster running in an unexpected direction can be reduced, allowing for stable use of the chair. In particular, the seat supported by the above-described support mechanism can be configured not to perform a monotonous pivotal operation around a certain fulcrum close to the floor, and thus, the pivotal trajectory of the seat can be accorded with the movement below the knees of the seated person, as a result of which it is easy to realize a proper support state in which the feet do not get stuck even when inclining forward.

Further, with such a support mechanism, there is no problem that the seat and the leg sink down every time the seated person sits down, and there is no inconvenience caused as in the case where the lower end of a supporting post comes in contact with the floor for pivoting.

Thus, in the chair of the present invention, when a seat surface inclines, the seat moves in a direction of the inclination, and thus, it is possible to configure a chair that extraordinarily well fits to the body movement of the seated person, and that, in view of a tendency of movement resulting from a human body structure of the seated person during sitting, can suitably support such a movement. As a result, according to the present invention, it is possible to provide a chair in which the seated person can perceive a comfortable sitting feeling even if sitting for a long time, and a high work efficiency can stably be maintained.

Further, a return force works which attempts to return the seat to the reference position in accordance with the movement of the seat, and thus, the seated person can perceive a pleasant feeling with a gentle motion as if sitting on a rocking chair.

When a lifting and lowering mechanism of the seat is adopted, in order to provide a compact configuration instead of a complicated structure where the support mechanism is merged with the lifting and lowering mechanism, it is preferable that the leg comprises the lifting and lowering mechanism, the seat is arranged above the lifting and lowering mechanism, and the support mechanism is interposed between the lifting and lowering mechanism and the seat.

Further, it is desirable to provide a rotation support mechanism configured to rotatably support the seat in a horizontal direction relative to the leg so that the seat can more suitably follow the movement of the seated person during work.

It is desirable that the omnidirectional connection unit is configured to connect by suspending the seat from the leg so that a more flexible operation in all directions and the return-force generation mechanism P being the return-force generation mechanism are realized at the same time with a simple configuration.

Further, it is preferable that the omnidirectional connection unit is configured as a link member having a universal joint structure extending in the up-down direction of which the both ends are supported pivotably in the directions including the front-rear direction and left-right direction so that the omnidirectional connection unit is further suitably operated.

Further, it is desirable that the link member is configured as a universal joint of which the both ends are pivotably supported in the directions including the front-rear direction and left-right direction and that the seat and the leg are coupled via the universal joint so as to allow a more flexible operation that further improves the followability to the movement of the seated person.

In order to realize a chair configured to be more compact in the up-down direction, it is preferable that a plurality of link members are arranged so that the up-and-down positions overlap at a position surrounding the center of the seat in planar view.

In order to minimize wobbling of the supported seat by link members and provide the seated person a more comfortable sitting feeling, it is preferable that the number of the link members provided is three.

In order to realize the operation of the seat that can follow faithfully the desirable movement of the seated person, it is desirable that the omnidirectional connection unit includes a guide surface formed along a predetermined trajectory and a follower configured to perform a relative operation following the guide surface.

In order to configure the above-described rotation support mechanism more compactly, it is desirable that the guide surface is integrally formed and that the support mechanism and the rotation support mechanism are integrally configured by configuring a plurality of followers so as to operate in any directions including front-rear and left-right direction along the guide surface.

When the support mechanism has a plurality of the followers and the guide surface is set so that there are always, of the plurality of the followers, at least one follower ascending and at least one another follower descending, during the operation of the seat, it is possible to more simply configure the center-of-gravity movement mechanism.

It is desirable that the guide surface has a substantially conical shape so that a smooth operation of the seat is realized.

Here, the "substantially conical shape" means the portion that contact with follower an outer peripheral surface of conical having formed, needless to say, it can be a truncated cone shape. In addition, an upper-lower relation between the guide surface and the follower does not matter. That is, the guide surface may have an upward curved shape that may contact a follower that faces downward, or a bowl shape that may contact a follower that faces upward.

In addition, it is so configured that the follower contacts the guide surface at three or more locations so that the follower stably contacts the guide surface, as a result of which it is possible to stably support the seat.

In order to realize a simple movement of the chair, it is desirable that the leg includes a caster configured to rollably contact a floor surface. That is, as in Japanese Unexamined Patent Application Publication (Translation of PCT Application) No. 10-513374, if in the chair, an element that grips the floor surface due to a frictional force during sitting contacts the floor surface, there is a problem that the person cannot move while seated. In contrary thereto, in the present invention, it is less likely that a horizontal force is exerted on the caster even if the seat is in an inclined state during sitting, and thus no other elements are needed which generate the frictional force onto the floor surface, as a result of which the seated person can move while seated when necessary.

In order to realize the above-described behavior of the seat with the support mechanism alone, it is effective that the support mechanism; comprises the omnidirectional connection unit configured to connect to the leg while supporting the bottom surface of the seat operably in all directions including the front-rear direction and the left-right direction; is configured to draw a trajectory along which the tip side in a movement direction of the seat is downwardly inclined in accordance with the movement of the supporting location of the seat; and further comprises the return-force generation mechanism configured to generate, by elevating the center of gravity of the seat, in accordance with the amount of movement, the return force in the direction of returning the supporting locations of the seat having moved from the reference position in the directions including the front-rear or left-right direction, to the reference position.

Effect of the Invention

With the above-described configuration, the present invention can provide a chair in which the seated person can perceive a comfortable sitting feeling even if sitting for a long time, and a high work efficiency can stably be maintained.

MODE FOR CARRYING OUT THE INVENTION

Each of embodiments of the present invention will be described below with reference to the drawings.

First Embodiment

A chair according to a first embodiment of the present invention is suitably used as an office rotating chair or the like that is suitably available in an office or at home.

Figure 1:
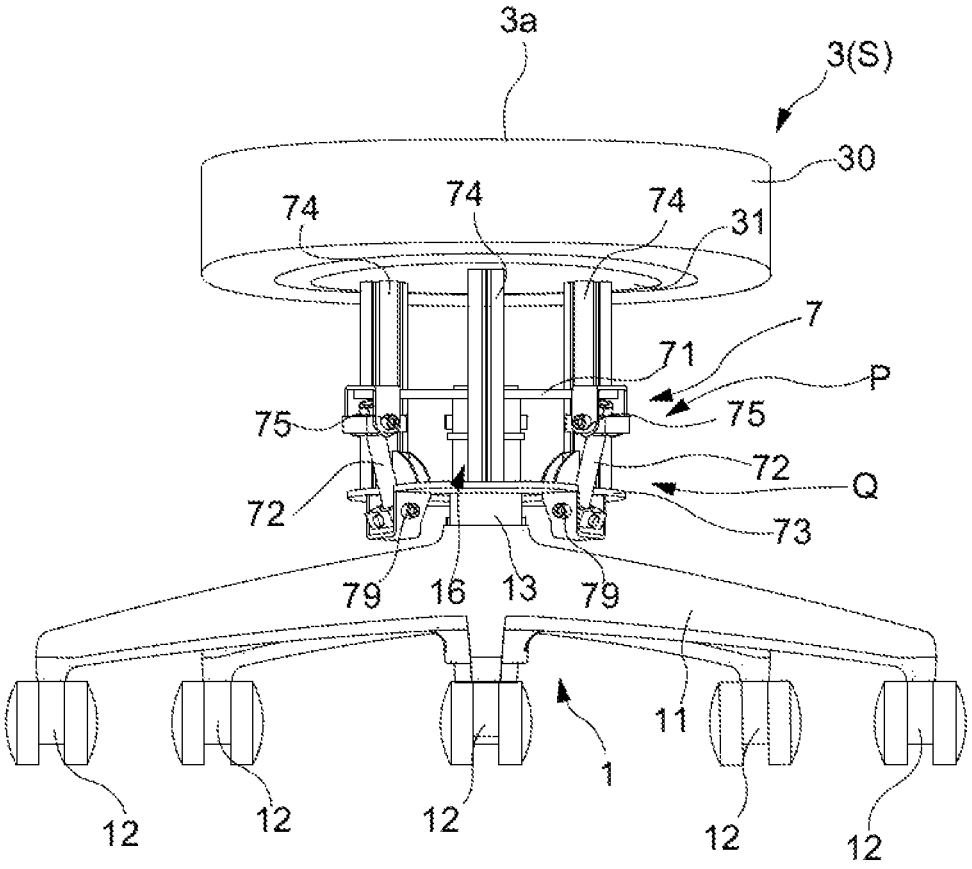
FIG. 1 is an appearance diagram according to a first embodiment of the present invention.
Figure 2:
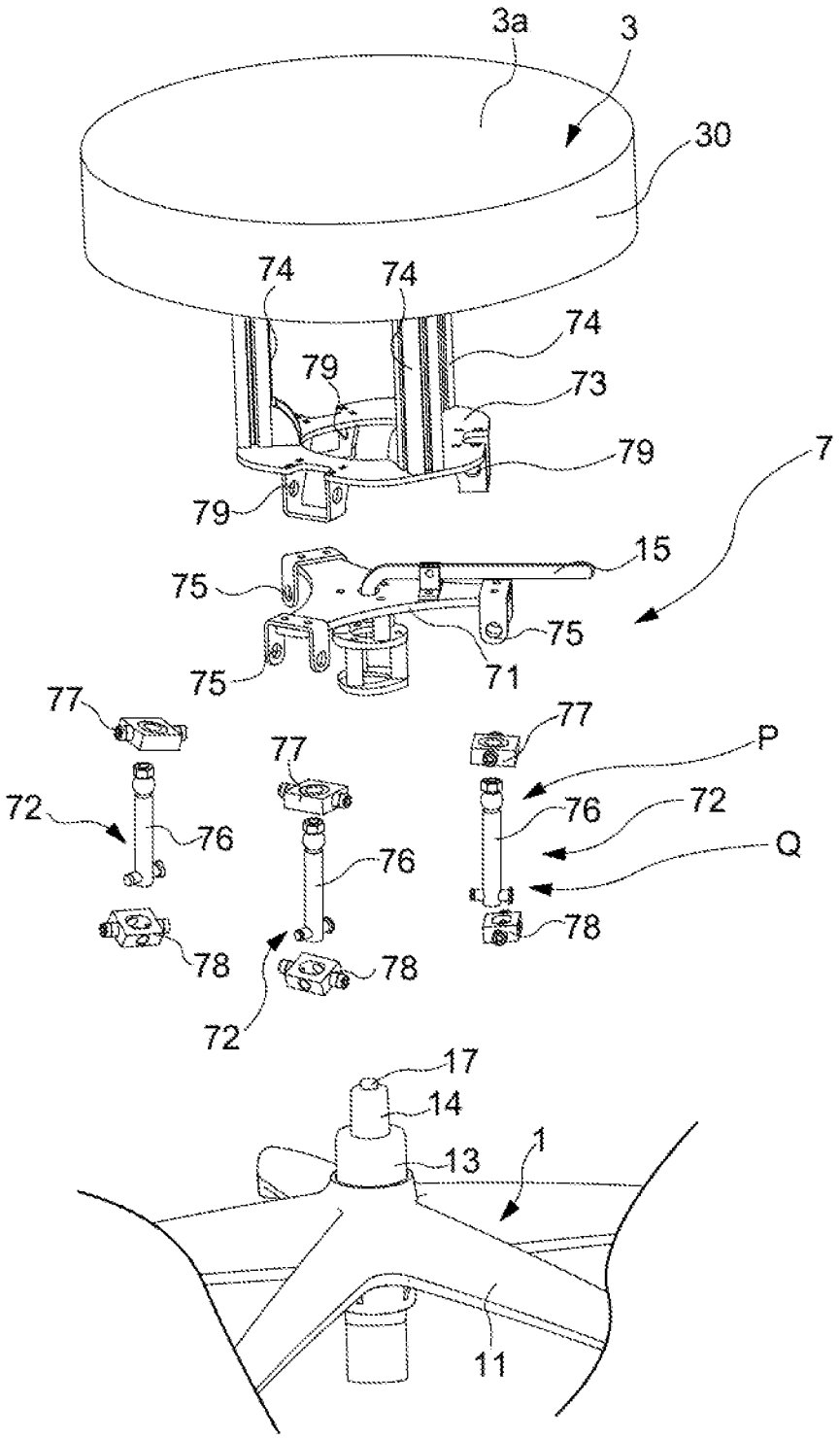
FIG. 2 is an exploded perspective view according thereto.
Figure 3:
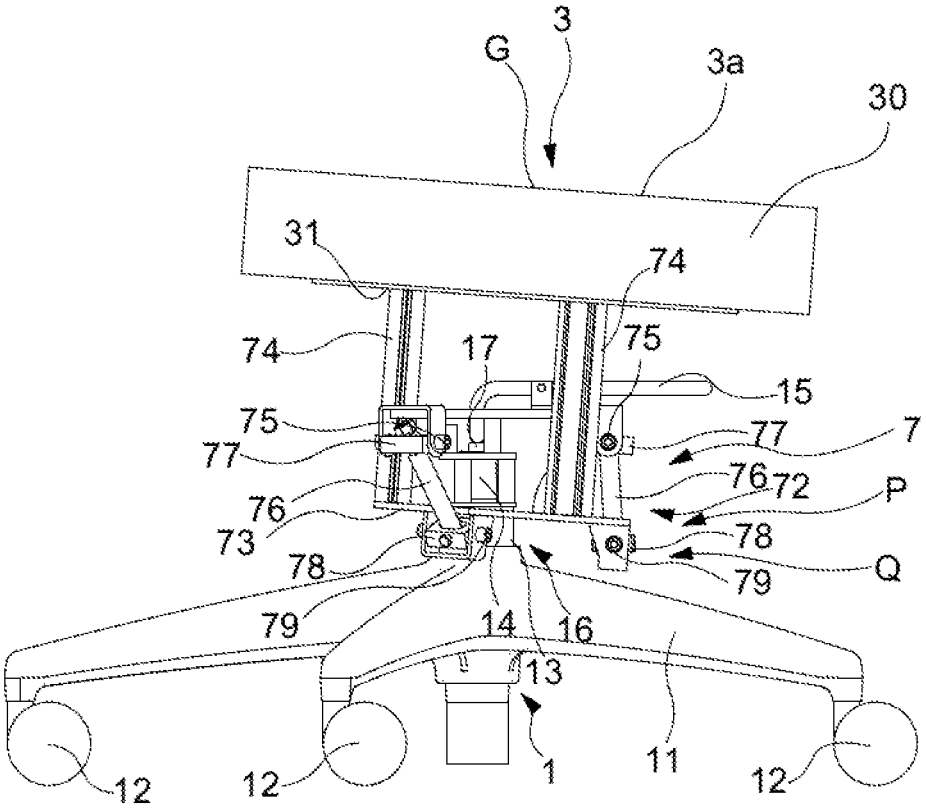
FIG. 3 is an operation explanatory diagram according thereto.

As illustrated in FIG. 1 to FIG. 3, in the chair, as an example, the illustration of the backrest 4 is omitted to further clarify the configuration of the seat 3 and the position of the seat surface 3*a*; however, it is not intended to exclude assembling of the backrest 4.

The leg 1 includes: a leg vane 11 formed radially in planar view; a caster 12 attached to a bottom side of the leg vane 11 and rollably contacting the floor surface; a leg supporting post 13 erected on a center of the leg vane 11; a gas spring 14 being a lifting up and down mechanism mounted within the leg supporting post 13 and configured to support the seat 3 in a lifting up and down manner, a rotation support mechanism 16 configured to support, in the vicinity of an upper end of the leg supporting post 13, the seat 3 to permit horizontal rotation by allowing a rod of the gas spring 14 to relatively rotate with respect to the leg supporting post 13; and an operation lever 15 configured to adjust a vertical position of the seat 3 by pressing a push button 17 arranged at an upper end of the gas spring 14 to extend and shrink the gas spring 14.

In the present embodiment, the seat 3 is constructed mainly of a seat main body 30, where a top surface of the seat main body 30 is a seat surface 3*a*, and a seat receiver 31 for supporting the seat 3 from below is attached on a bottom surface side of the seat main body 30.

Here, a chair according to the present embodiment is provided with a joint support mechanism 7 being a support mechanism interposed between the leg 1 and the seat 3. Further, the joint support mechanism 7 is arranged below the seat 3 and includes a both-end universal joint 72 being an omnidirectional connection unit configured to operably connect the seat 3 in all directions including the front-rear direction and the left-right direction, and thus, it is possible to movably support the seat 3 along a predetermined trajectory. The joint support mechanism 7 includes a seat inclining function configured to downwardly incline a tip side in a movement direction of the seat 3 in accordance with movement of the seat 3 from a predetermined reference position (S), and further includes a center-of-gravity movement mechanism P being a return-force generation mechanism configured to generate, by elevating a center of gravity G of the seat 3 in accordance with the operation of the seat 3 from the reference position (S), in accordance with an amount of movement, a return force in a direction of returning the seat 3 to the reference position (S).

Further, in the chair according to the present embodiment, the support mechanism 7 configured to operatively support the seat 3 in the directions including the front-rear direction and the left-right direction along a predetermined trajectory by suspending a part of the seat 3 from a part of the leg 1 is the joint support mechanism 7 being a link mechanism including the link member extending in the up-down direction, and the link member is a both-end universal joint 72 being a universal joint of which the both ends are operatively supported in the directions including in the front-rear direction and in the left-right direction. In addition, in the present embodiment, when the joint support mechanism 7 allowing the seat 3 and the leg 1 to be coupled via the both-end universal joints 72 is provided, the seat 3 is configured to be operable in directions including the front-rear direction and the left-right direction.

Further, to realize the above-described behavior of the seat 3 alone, the joint support mechanism 7 according to the present embodiment; comprises the both-end universal joints 72 being the omnidirectional connection unit configured to connect the seat 3 to the leg 1 while operably supporting the bottom surface of the seat 3 in all directions including the front-rear direction and the left-right direction; is configured to draw a trajectory along which the tip side in a movement direction of the seat 3 is downwardly inclined in accordance with movement of a supporting location of seat 3; and further comprises a center-of-gravity movement mechanism P being a return-force generation mechanism configured to generate, by elevating the center of gravity G of the seat 3, in accordance with the amount of movement, the return force in the direction of returning the supporting locations of the seat 3 having moved from the reference position (S) in the directions including the front-rear or left-right direction, to the reference position (S). A configuration of the joint support mechanism 7 will be described specifically below.

As illustrated in FIG. 1 to FIG. 3, the joint support mechanism 7 is interposed between the leg 1 and the seat 3, and applies the link mechanism having the both-end universal joints 72 being the link member extending in the up-down direction so as to operatively support the seat 3 along a predetermined trajectory along which the seat 3 is operated in the directions including the front-rear direction and the right-left direction. The joint support mechanism 7 is configured to be interposed between the upper end portion of the leg 1 and the lower end portion of the seat receiver 31.

The joint support mechanism 7 includes a suspension board 71 provided in an upper end portion of the leg 1, the both-end universal joints 72 of which the upper end portion is connected to the suspension board 71, a swing board 73 connected to a lower end portion of the both-end universal joints 72, and a seat support post 74 erected on the swing board 73 and configured to support the seat 3 at a height position higher than the suspension board 71.

The suspension board 71 is fixed to a horizontally rotatable location at the upper end of the leg 1 by the rotation support mechanism 16 provided in the leg 1 and forms an annular shape in planar view around the leg supporting post 13. In the suspension board 71, portions at three locations on the outside are suspended, and the suspended portions are punched with an upper connection hole 75 for connecting to the upper end of the both-end universal joints 72.

In the both-end universal joints 72 being three link members, the upper end portion is attached to be suspended down from the upper connection hole 75 of the suspension board 71, and the lower end portion is connected to the swing board 73. The both-end universal joints 72 includes a joint main body 76 extending in the up-down direction, an upper connection unit 77 configured at the upper end of the joint main body 76, the upper connection unit being pivotally attached onto the suspension board 71, and a lower connection unit 78 configured at the bottom end of the joint main body 76, the lower connection unit being pivotally attached onto the swing board 73. Further, in the three both-end universal joints 72 being link members, a distance between the lower connection units 78 provided at the lower end is set to be shorter than a distance between the upper connection units 77 provided at the upper end.

The swing board 73 is a board-like shape of an annular shape in planar view around the leg supporting post 13 suspended and supported onto the suspension board 71 via the both-end universal joints 72, and includes a lower connection hole 79 configured to connect to the lower connection unit 78 provided at the lower end of the both-end universal joints 72 at three locations on the outer circumference surface.

The seat support post 74 is configured so that the lower end portions are each fixed at three locations on the top surface of the swing board 73, it stands upwardly in a substantially vertical direction at the reference position (S) at which the seat 3 does not make any operation, and the upper end portions are fixed to the seat receiver 31. That is, the seat 3 is configured so that the vertical thicknesses are substantially constant as illustrated, and thus, the top surface of the swing board 73 and the seat surface 3*a* are configured to substantially face in the same direction. Further, the seat support post 74 is arranged at a substantially intermediate position between the both-end universal joints 72, so that when the seat support post 74 operates, it does not interfere with the both-end universal joints 72 itself and the operation thereof.

An operation of the seat 3 according to the present embodiment will be described, below. FIG. 1 illustrates a predetermined reference position (S) at which the seat 3 rests by its own weight, and FIG. 3 illustrates a behavior of the seat 3 when the seat 3 operates into any direction. Not only in a state illustrated in FIG. 3, but also when the seat 3 operates from the reference position (S) into any direction, its operation is against the gravity. Specifically, when any or all of the lower connection units 78 provided at the lower end of the both-end universal joints 72 are elevated, the position of the center of gravity G of the seat surface 3*a* rises from the reference position (S). At this time, the return force exerted by the gravity in a direction of returning the seat to the reference position (S) is spontaneously applied to the seat. That is, in the present embodiment, the both-end universal joint 72 is the return-force generation mechanism, and functions as the center-of-gravity movement mechanism P configured to elevate the center of gravity G of the seat 3 in accordance with the operation of the seat 3 from the reference position (S). In addition, as illustrated in FIG. 3, the seat surface 3*a* that has operated takes a posture in which the operation tip side is always descended. This results from the feature, as described above, that the distance between the lower connection units 78 provided at the lower end of the both end universal joints 72 is set to be shorter than the distance between the upper connection units 77 provided at the upper end of the both-end universal joints 72. That is, in the present embodiment, the both-end universal joint 72 also functions as the seat inclining mechanism Q.

Further, the chair according to the present embodiment, as described above, applies to the structure capable of realizing the above-described operation with the simple configuration in that the seat 3 is suspended at three locations by the both end universal joints 72 and thus, the chair is suitable for configuring not only an office rotating chair, but also a simplified stool or a low-priced chair with a simple configuration.

Thus, the chair according to the present embodiment not only can suitably maintain a posture of the seated person during sitting, but also can suitably support the movement of the seated person during sitting. Specifically, when the both end universal joints 72 being the omnidirectional connection unit is applied, it is possible to suitably support the movement of the seated person without being unnecessarily influenced in the mobile direction from a predetermined operation direction having been set to the chair or the shape of the mechanism component on the movement of the person such as moving repeatedly the seat 3 in all directions including the front-rear direction and the left-right direction from a reference position (S). Further, even if the seated person moves the center of gravity G to the front, rear, right, and left, the return-force generation mechanism is configured to be the center-of-gravity movement mechanism P configured to elevate the center-of-gravity G of the seat 3 in accordance with the movement of the seat 3 from the reference position (S) and thus, it is possible to reduce a need for the seated person to brace his/her feet to the floor to rest in a proper posture. In addition, it is possible to provide a trajectory appropriate for each of the front-rear direction and the left-right direction, and thus, even if the body movement of the seated person is different between the front and the rear, or even if the body movement of the seated person is different between the front-rear and the left-right, it is still possible to realize a support state properly corresponding to the body movement of the seated person.

Further, it is not highly necessary for the seated person to brace his/her feet to the floor to assure balance, and thus, even if a lower end of the leg 1 is supported by casters 12, a risk of the casters 12 running in an unexpected direction can be reduced, realizing a stable use of the chair. In particular, the seat 3 supported by the above-described joint support mechanism 7 can be set not to perform a monotonous pivotal operation around a certain fulcrum close to the floor, and thus, the pivotal trajectory of the seat 3 can be accorded with or close to the operation below the knees of the seated person, as a result of which a proper support state is realized in which the feet do not get stuck even when inclining forward.

Further, with such a joint support mechanism 7, there is no problem that the seat 3 or the leg 1 sinks down every time the seated person sits down, and there is no inconvenience caused as in the case where the lower end comes in contact with the floor for pivoting like the supporting post. Thus, in the chair according to the present invention, when the seat surface 3*a* inclines, the seat 3 moves to the inclining direction, and thus, the chair can well fit to the body movement of the seated person.

That is, according to the present embodiment, a chair is realized in which the seated person can perceive a comfortable sitting feeling even if sitting for a long time, and furthermore, a high work efficiency can stably be maintained.

Additionally, in the present embodiment, the leg 1 includes a lifting up and down mechanism having the gas spring 14, the seat 3 is arranged above the lifting up and down mechanism, and the support mechanism 7 is interposed between the lifting up and down mechanism and the seat 3, and thus, a compact configuration is realized, instead of a complicated structure in which the joint support mechanism 7 is merged with the lifting up and down mechanism.

Further, in the present embodiment, a rotation support mechanism 16 configured to support the seat 3 rotatably in a horizontal direction is provided, and thus, the movement of the seated person during work may be more suitably followed.

Further, according to the present embodiment, the omnidirectional connection unit is constructed as the both-end universal joint 72 configured to connect by suspending the seat 3 from the leg 1 and thus, a more flexible operation in all directions and the return-force generation mechanism P being the return-force generation mechanism can be realized at the same time with a simple configuration.

In particular, in the present embodiment, as a mode of the omnidirectional connection unit, the link members are configured as the both-end universal joints 72 having a universal joint structure that are pivotably supported the both ends in the directions including the front-rear direction and left-right direction, and the seat 3 and the leg 1 are coupled via the both-end universal joints 72. This enables a more flexible operation which can further improve the followability to the movement of the seated person.

Further, in the present embodiment, when a plurality of both-end universal joints 72 being link members are arranged so that the up-and-down positions overlap at a position surrounding the center of the seat 3 in planar view, a chair configured to be more compact in the up-down direction is realized.

Further, in the present embodiment, when the configuration is applied in which the seat 3 is suspended by the three both-end universal joints 72 being link members, it is possible to minimize wobbling of the supported seat 3, as a result of which the seated person is given a more comfortable sitting feeling. It is noted that, the present embodiment will not exclude the configuration that the four or five or more both-end universal joints 72 being link members are provided to realize a more stable support for the seat 3.

In addition, in the present embodiment, the leg 1 includes the casters 12, and thus, it is possible to prevent the chair from easily moving even if the seat 3 operates forward, rearward, rightward, or leftward while the seated person can move together with the chair while being seated when required. This eliminates an element for gripping the floor surface by frictional force to operating the seat 3 during sitting, unlike in Japanese Unexamined Patent Application Publication (Translation of PCT Application) No. 10-513374.

In particular, in the present embodiment, to realize the behavior of the above-described seat 3 with the joint support mechanism 7 alone, the joint support mechanism 7; comprises the both-end universal joints 72 being the omnidirectional connection unit configured to connect to the leg 1 while operably supporting the bottom surface of the seat 3 in all directions including the front-rear direction and the left-right direction; is configured to draw a trajectory along which the tip side in a movement direction of the seat 3 is downwardly inclined in accordance with the movement of a supporting location of the seat 3; and further comprises a center-of-gravity movement mechanism P being a return-force generation mechanism configured to generate, by elevating the center of gravity G of the seat 3, in accordance with the amount of movement, the return force in the direction of returning the supporting locations of the seat 3 having moved from the reference position (S) in the directions including the front-rear or left-right direction, to the reference position (S).

Further, the embodiment is not, of course, limited to a mode in which the seat is suspended by the both-end universal joints being plurality of link members. In other words, a mode in which the seat is supported from below by the both-end universal joints shall not be precluded from the present invention.

A modification of the present invention, as well as other embodiments, will be described below. In the following embodiments and modifications, elements corresponding to constituent elements of the embodiment described above will be referred to by the same reference numerals and detailed description thereof will be omitted.

Second Embodiment

A chair according to a second embodiment of the present invention may be suitably utilized as a rotating chair as illustrated in FIG. 4 to FIG. 8. The chair is similar to that in the above-described embodiment in that the leg 1 coming in contact with the floor surface and the seat 3 provided above the leg 1 are provided. Further, in the present embodiment, for convenience of illustration, in the seat 3, only the seat receiver 31 of sheet form is illustrated; however, the seat 3 similar in mode to the above-described embodiment may be applied. Unlike the seat 3 according to the above-described embodiment, a mode in which the backrest 4 is not integrally provided may be applied to the seat 3, and a conventional configuration may be widely applied to the seat 3.

Further, the leg 1 is similar in configuration to the above-described embodiment other than the configuration in which the rotation support mechanism 16 as a part of the leg 1 configured to rotatably support the seat 3 is not provided, and thus, the description will be omitted. Further, the chair according to the present embodiment is similar to the above-described embodiment in that the support mechanism is configured across the upper end portion of the leg 1 to the seat receiver 31.

However, because the chair according to the present embodiment differs in configuration of the support mechanism from that in the above-described embodiment, the return-force generating mechanism and the seat inclining mechanism Q are also configured in a different mode.

Here, the chair according to the present embodiment has a guide support mechanism 8 being a support mechanism interposed between the leg 1 and seat 3. Further, the guide support mechanism 8 is arranged below the seat 3, includes; a sliding contact follower 82 and a guide curved surface 83 being the omnidirectional connection unit configured to contact so as to operatively support the seat 3 in all directions including the front-rear direction and the left-right direction, and thus, it is possible to movably support along a predetermined trajectory, comprises: a seat inclining function configured to downwardly incline a tip side in a movement direction of the seat 3 in accordance with movement of the seat 3 from a predetermined reference position (S), and further comprises: a center-of gravity movement mechanism P being a return-force generation mechanism configured to generate, by elevating the center-of-gravity G of the seat 3 in accordance with the movement of the seat 3 from the reference position (S), in accordance with an amount of movement, a return force in a direction of returning the seat 3 to the reference position (S).

That is, the chair according to the present embodiment is similar to that in the above-described embodiment in that it has the support mechanism interposed between the leg 1 and the seat 3, the support mechanism being configured to operatively support the seat 3 by the relative operation between the guide surface and the follower, and the support mechanism including the guide surface formed along a predetermined trajectory along which the seat 3 is operated in the directions including the front-rear direction and the left-right direction and the follower configured to perform the sliding operation following the guide surface. A difference is that when the chair is so configured that the guide surface is an integrally formed guide curved surface 83 and a plurality of followers or sliding contact followers 82 can operate in any direction of the front and rear directions and right and left directions along the guide curved surface 83, a guide support mechanism 8 is provided which can serve a role as a rotation support mechanism configured to rotatably support the seat 3 in the horizontal direction, in addition to a role of the support mechanism providing the same effect as in the above-described embodiment.

Further, the guide support mechanism 8 according to the present embodiment, to realize the behavior of the above-described seat 3 with the guide support mechanism 8 alone, the guide support mechanism has the sliding contact follower 82 and the guide curved surface 83 being the omnidirectional connection unit configured to connect to the leg 1 while supporting operably the bottom surface of the seat in all directions including the front-rear direction and the left-right direction; is configured to draw a trajectory along which the tip side in a movement direction of the seat is downwardly inclined in accordance with the movement of a supporting location of the seat; and further includes the return-force generation mechanism configured to generate, by elevating the center of gravity of the seat, in accordance with the amount of movement, the return force in the direction of returning the supporting locations of the seat having moved from the reference position in the directions including the front-rear or left-right direction, to the reference position.

As illustrated in FIG. 4 to FIG. 7, in order to operatively support the seat 3 along a predetermined trajectory, interposed between the leg 1 and the seat, along which the seat is operated in the directions including the front-rear direction and left-right direction, the guide support mechanism 8 applies a configuration having a guide board 81 having a guide curved surface 83 of substantially conical shape or truncated cone shape and a sliding contact follower 82 that can slide on the guide curved surface 83 in any direction. This guide support mechanism 8 is configured to be interposed between the upper end portion of the leg 1 and the lower end portion of the seat receiver 31. Further, though it is not illustrated in the present embodiment in particular, the guide support mechanism 8 has a different configuration that, for example, in that even if the seat 3 is held and raised up, too much unnecessary space is not made between the guide curved surface 83 and the sliding contact follower 82. The detailed description of this configuration will be omitted since the conventional and various configurations can be applied.

The guide board 81 is formed of a hard material fixed at the upper end of the leg 1. The guide board 81 is so shaped that a portion in the vicinity of an outer edge is dented downwardly into a substantially exact circular shape in planar view, and further a portion surrounded by the dented portion is elevated into a substantially truncated cone shape so as to be gradually higher toward a center portion. In addition, the elevated portion formed by denting the portion in the vicinity of the outer edge is configured as a restriction wall 84 configured to restrict an operation range of the sliding contact follower 82, and the curved surface surrounded by the restriction wall 84 is configured as the guide curved surface 83. Specifically, the shape of the guide curved surface 83 has a curved surface shape such that the degree of inclination gradually becomes larger as being closer to the center of the guide board 81 from the vicinity of an outer periphery thereof. Note that in the present embodiment, the center of the guide board 81 is configured in a planar form; however, the sliding contact follower 82 is set to not slide over the planar portion.

In the present embodiment, the sliding contact follower 82 is arranged with respect to the seat receiver 31 at six locations being at least three or more locations allowing for a stable self-standing, so that each location corresponds to a relative position corresponding to each vertex of an equilateral hexagon in planar view. In another words, the sliding contact follower 82 is arranged at a relative position which can be arranged in equal intervals on the outline of the exact circle. The sliding contact follower 82 includes a follower main body 85 having a substantially spherical shape slidingly contacting the guide curved surface 83 and a seat supporting post 86 of which the lower end portion is supported by the follower main body 85 and of which the upper end portion is fixed to the seat receiver 31.

Figure 4:
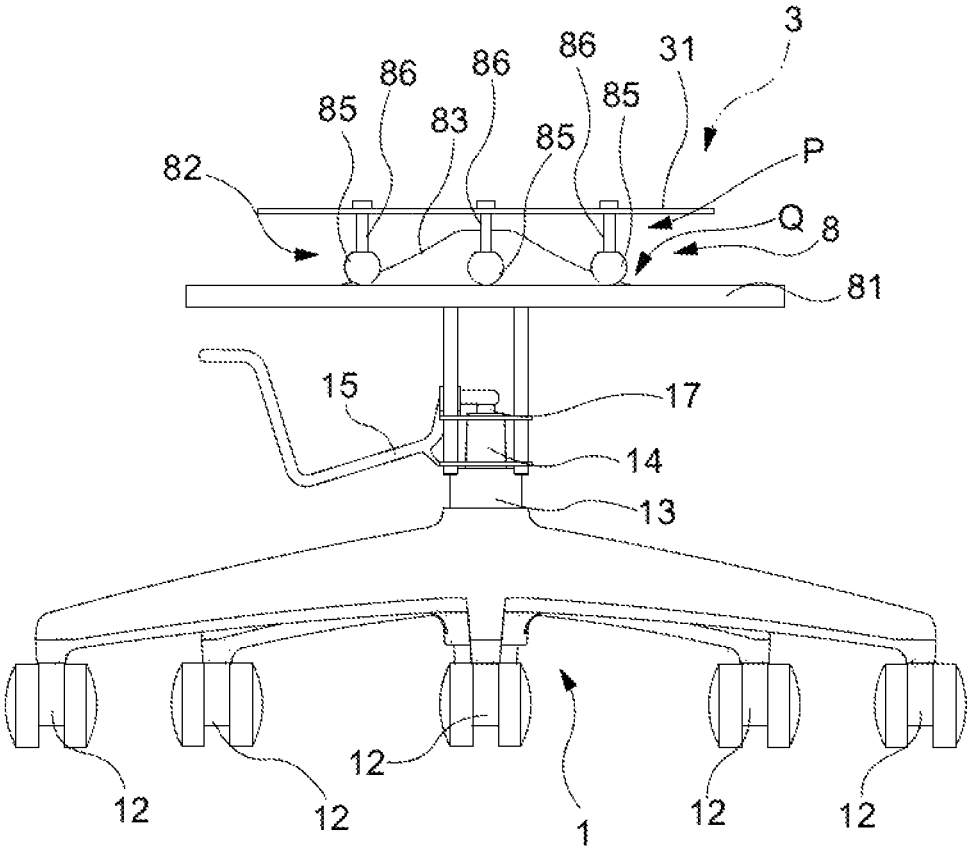
FIG. 4 is a front view according to a second embodiment of the present invention.
Figure 5:
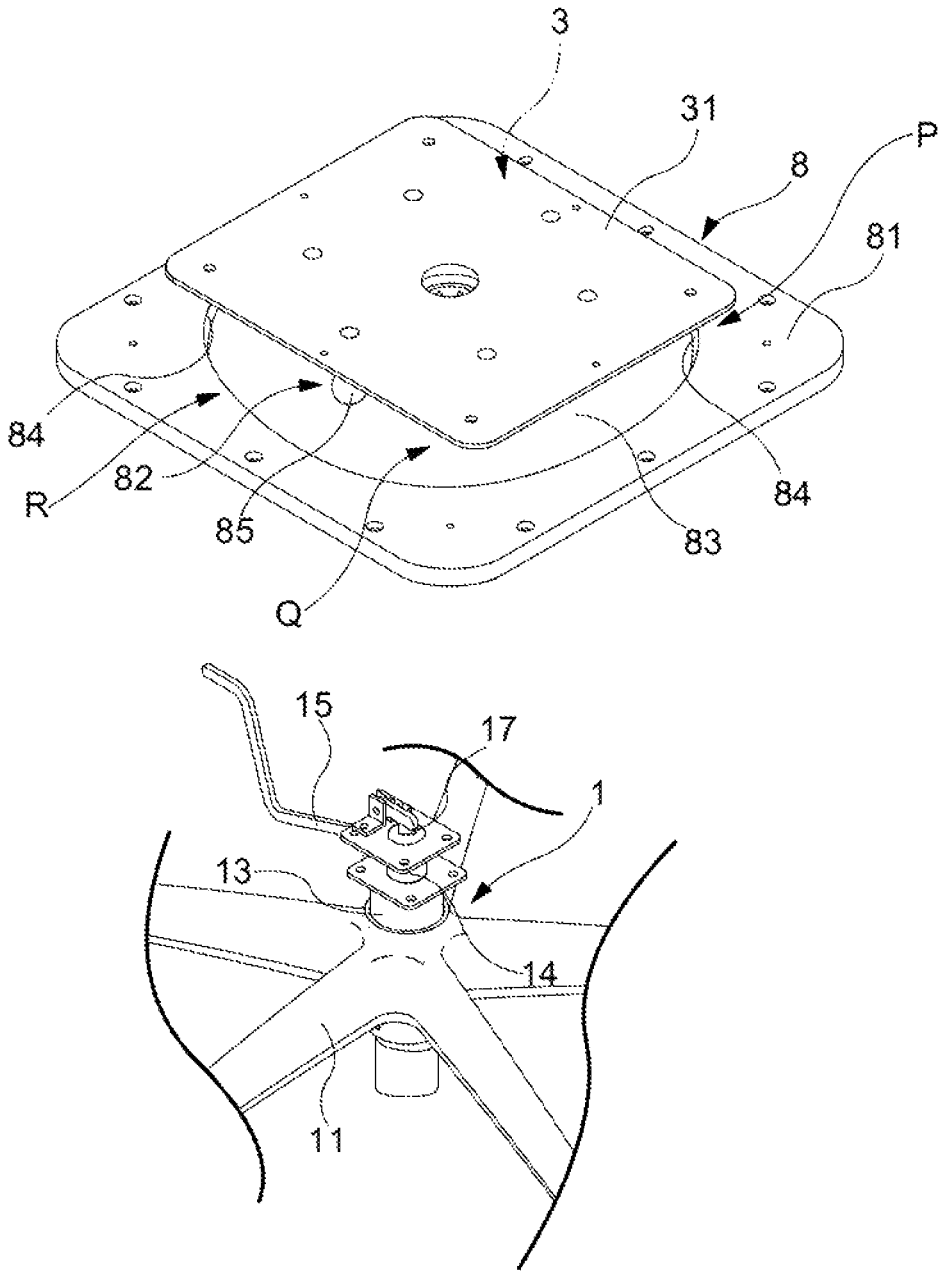
FIG. 5 is an exploded perspective view according thereto.
Figure 6:
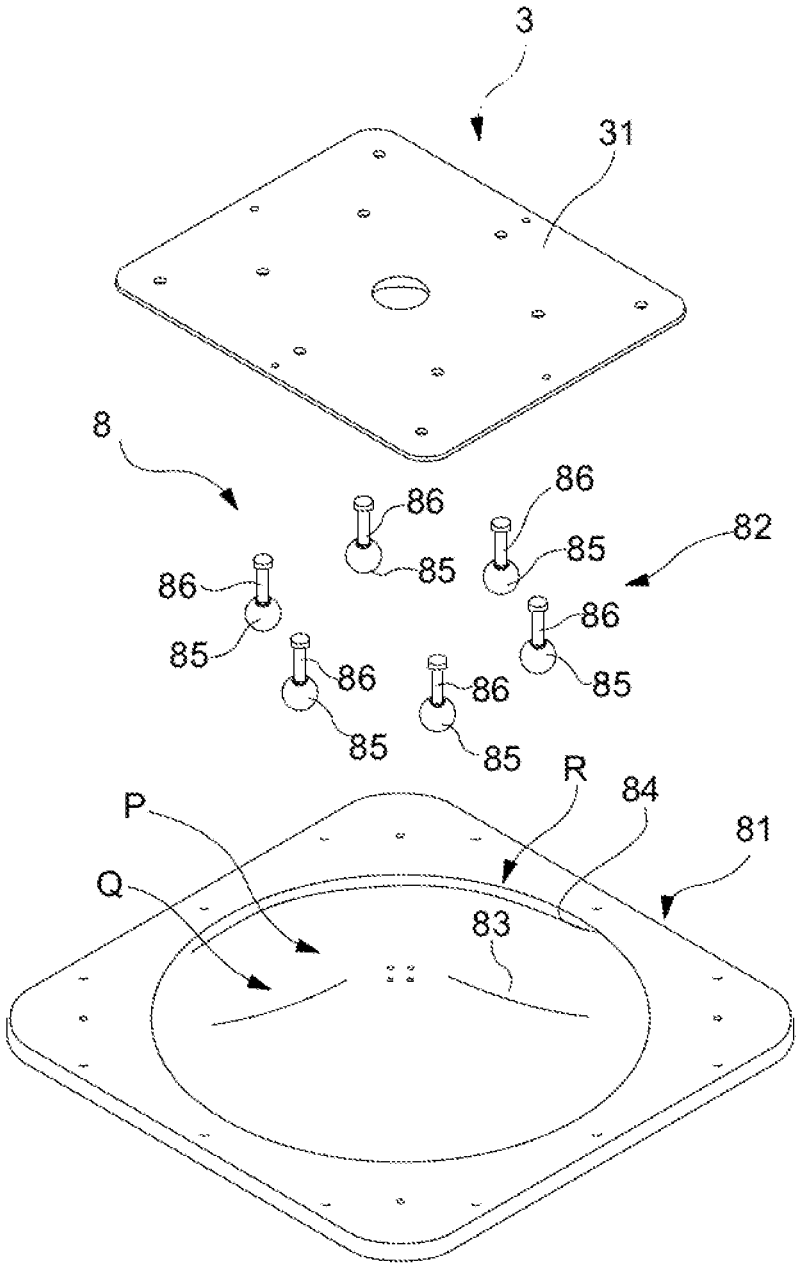
FIG. 6 is an exploded perspective view according thereto.
Figure 7:
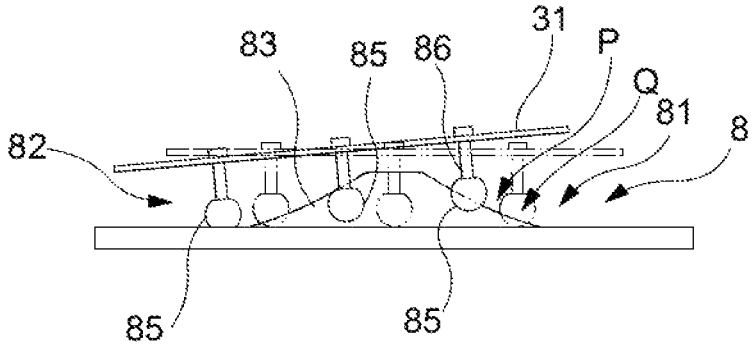
FIG. 7 is an operation explanatory diagram according thereto.
Figure 7:
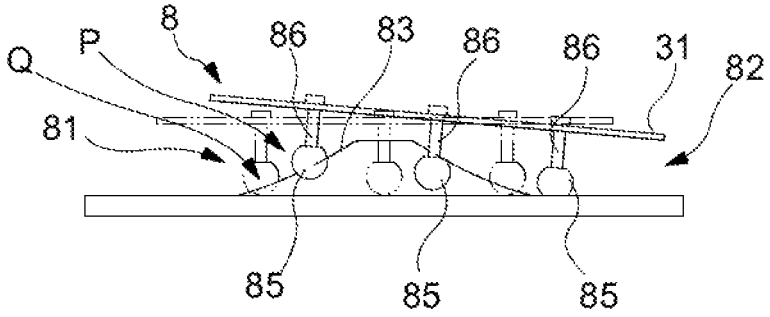

An operation of the seat 3 according to the present embodiment will be described, below. FIG. 4 illustrates only the seat receiver 31, however, it is a behavior or the seat receiver 31 at a predetermined reference position (S) at which the seat 3 rests by its own weight, and FIG. 7 illustrates a behavior of the seat receiver 31 when the seat 3 operates in any direction. In the present embodiment, not only in a state illustrated in FIG. 7, but also when the seat 3 operates from the reference position (S) into any direction, its operation is against the gravity. Specifically, the guide curved surface 83 being a guide surface is provided so that there are always, of the six sliding contact followers 82, some sliding contact followers 82 ascending and the other sliding contact followers 82 descending, during the operation of the seat. As a result, in the configuration of the present embodiment, the position of the center of gravity of the seat receiver 31 rises from the reference position (S). Further, at this time, a return force exerted by the gravity in a direction of returning the seat 3 to the reference position (S) is spontaneously applied to the seat 3. That is, in the present embodiment, the guide curved surface 83 and the sliding contact follower 82 are the return-force generation mechanism and function as the center-of-gravity movement mechanism P configured to elevate the center of gravity G of the seat 3 in accordance with the operation of the seat 3 from the reference position (S). In addition, the seat receiver 31 that has operated is in a posture in which the operation tip side is descended. As described above, this results from the feature that the guide curved surface 83 is in a substantially truncated cone shape. That is, in the present embodiment, the guide curved surface 83 also functions as the seat inclining mechanism Q.

Modification

Figure 8:
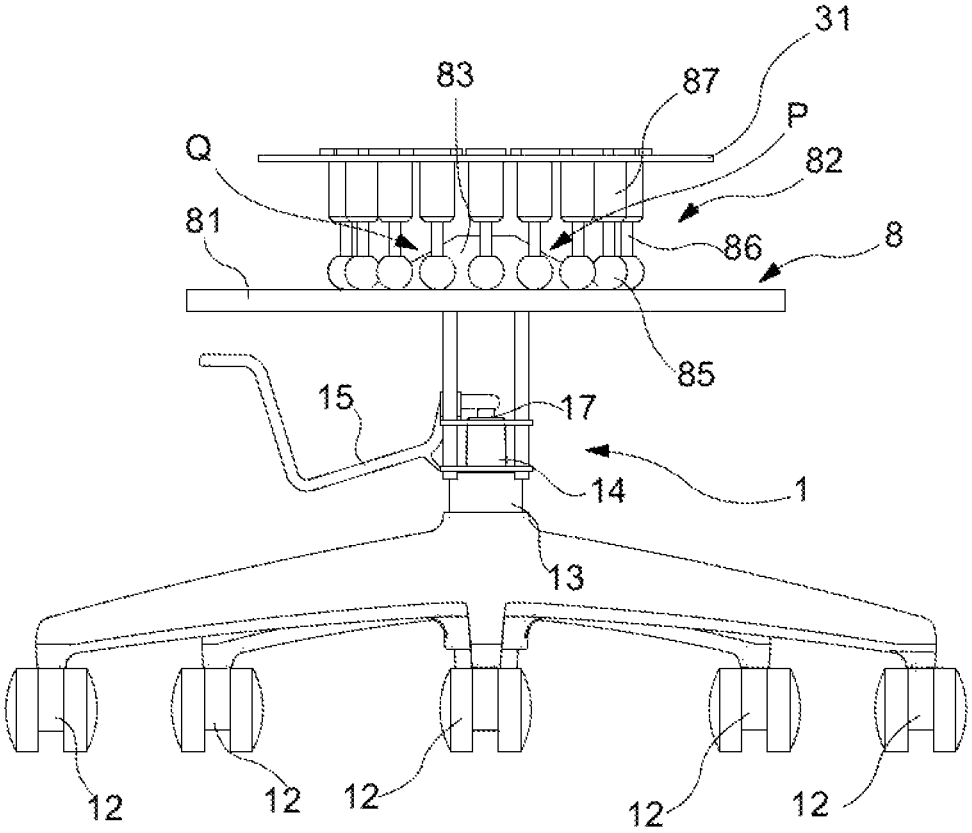
FIG. 8 is a front view according to a modification of the second embodiment.

In the above-described present embodiment, a mode is disclosed in which each of the six sliding contact followers 82 is firmly fixed to the seat receiver 31; however, as illustrated in FIG. 8, needless to say, a spring 87 may be separately arranged in the sliding contact follower 82.

In the present modification, in addition to the follower main body 85 and the seat supporting post 86 similar to those in the above-described embodiment, the sliding contact follower 82 further includes a spring 87 interposed between the seat supporting post 86 and the seat receiver 31. In the spring 87, a pressure coil spring of which the upper end portion is fixed to the seat receiver 31 side and the lower end portion is fixed to the upper end portion of the seat supporting post 86, is installed. This results in reducing a shock applied to the seated person during sitting being relieved, and contributes to smoother operation of the seat 3.

Further, as illustrated in FIG. 8, needless to say, the number of the sliding contact followers 82 is not limited to six, and as long as it is three or more which allows the follower to configure to stand by itself, seven or more sliding contact followers 82 may be arranged concentrically. It is noted that in the modification, 18 sliding contact followers 82 are arranged concentrically.

According to the configuration as described above, the chair according to the present embodiment and the modification is possible to accomplish an operation and effect similar to those in the first embodiment. In particular, when the sliding contact follower 82 and the guide curbed surface 83 being the omnidirectional connection unit is applied, it is possible suitably support the movement of the seated person without being unnecessarily influenced in the mobile direction from a predetermined operation direction having been set to the chair or the shape of the mechanism component on the movement of the person such as moving repeatedly the seat 3 in all directions including the front-rear direction and the left-right direction from a reference position (S).

In particular, in the present embodiment, when it is so configured that the guide surface is the integrally formed guide curved surface 83, and a plurality of followers or the sliding contact followers 82 can freely contact slidingly along the guide curved surface 83 in any direction of the front and rear directions and the left and right directions, it is possible to integrally configure the support mechanism similar to that in the above-described embodiments and the rotation support mechanism similar to the rotation support mechanism 16 that is one constituent element of the leg 1 in the above-described embodiments to realize a compact chair as a whole.

In addition, in the present embodiment, when there are a plurality of sliding contact followers 82, specifically, three or more sliding contact followers 82, and the guide curved surface 83 is set so that there are always, of the plurality of sliding contact followers 82, some sliding contact followers 82 ascending and the other sliding contact followers 82 descending, during the operation of the seat 3, it is possible to more simply configure the center-of-gravity movement mechanism P similar to that in the above-described embodiments.

In addition, in the present embodiment, a smooth operation of the seat 3 can be realized by configuring so that the guide curved surface 83 being a guide surface has a substantially conical shape.

In particular, in the present embodiment, when it is so configured that the sliding contact follower 82 always contacts the guide curved surface 83 at three or more locations, the sliding contact follower 82 stably contacts the guide curved surface 83, as a result of which it is possible to stably support the seat receiver 31 and the seat 3 as well.

Modification

Modification of the first embodiment as above described will be described below with reference to FIG. 9.

A chair according to the present modification illustrates more specifically a configuration for attaching the seat receiver 31 and the backrest 4, while substantially following the configuration of the joint support mechanism 7 as above described.

That is, the chair is similar to that in the above-described embodiment in that the leg 1 coming in contact with the floor surface and the seat 3 provided above the leg 1 are provided. Further, as above described, the seat 3 is not formed integrally with the backrest 4.

Figure 9:
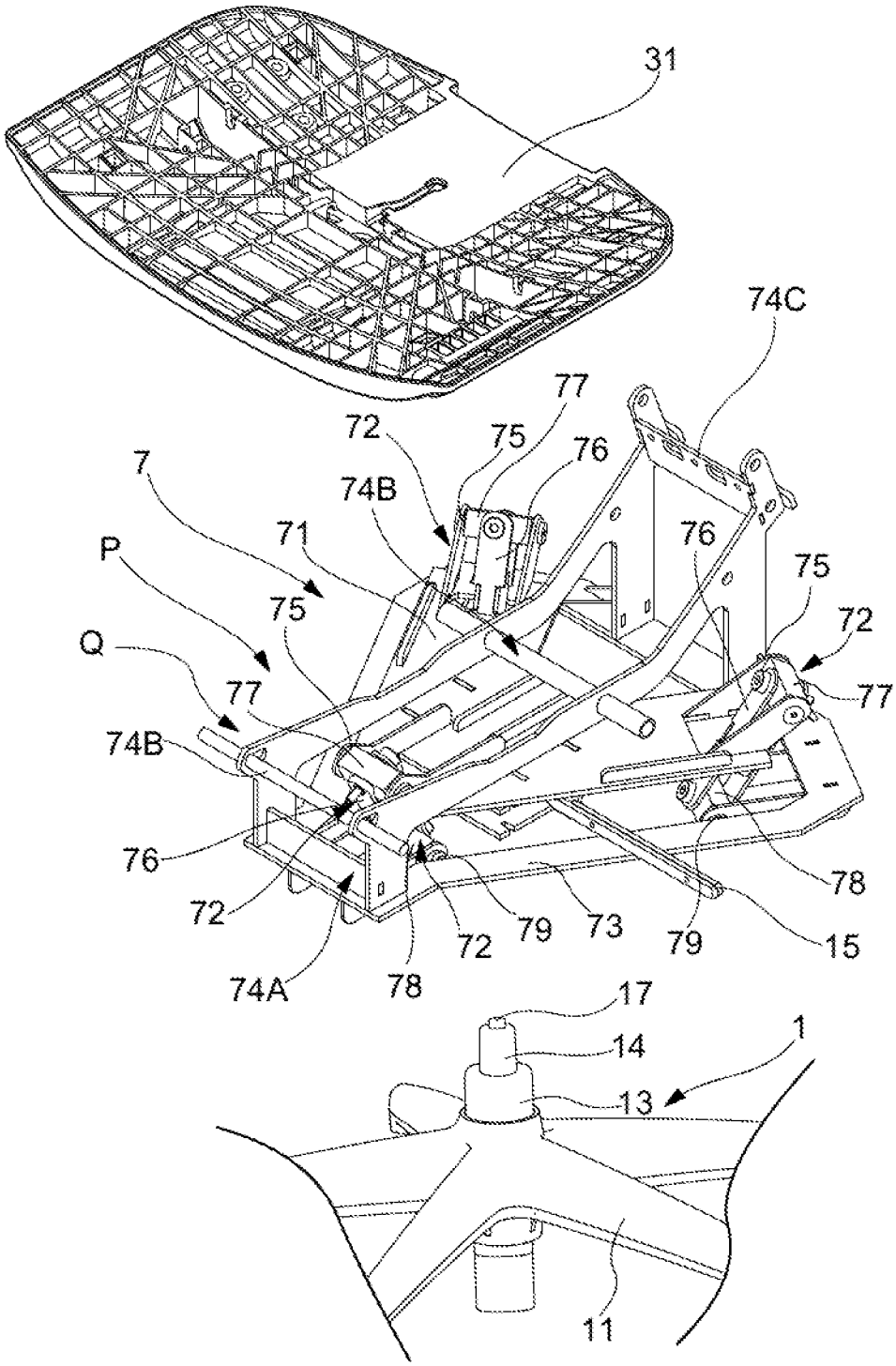
FIG. 9 is a configuration explanatory diagram according to a modification of the first embodiment.

As illustrated in FIG. 9, similarly to that in the first embodiment, the joint support mechanism 7 is interposed between the leg 1 and the seat 3, and applies the link mechanism having the both-end universal joint 72 being a link member extending in the up-down direction so that the seat 3 can be operatively supported along a predetermined trajectory along which the seat 3 is operated in the directions including the front-rear direction and in the right-left direction. The joint support mechanism 7 is configured to be interposed between the upper end portion of the leg 1 and the lower end portion of the seat receiver 31.

The joint support mechanism 7 includes the suspension board 71 provided in an upper end portion of the leg 1, the both-end universal joint 72 of which the upper end portion is connected to the suspension board 71 and the swing board 73 connected to a lower end portion of the both-end universal joint 72.

Here, in the modification, instead of the seat support 74 according to the above-described embodiments, a backrest and seat attaching part 74A erected on the swing board 73 and configured to support the seat 3 and the backrest 4 at a height position higher than the suspension board 71 is further provided.

The suspension board 71 is fixed to a horizontally rotatable location at the upper end of the leg 1 by the rotation support mechanism 16 provided in the leg 1 and forms a substantially triangular annular shape in planar view around the leg supporting post 13. In the suspension board 71, a part at three locations being an angle portion is risen obliquely upward, and an upper connection hole 75 is bored in the risen portions for connecting to the upper end of the both-end universal joints 72. Further, in the embodiment, the suspension board 71 is formed so that constituent elements of the leg 1 illustrated on the lower side at the center in planar view of the suspension board 71 are assembled and an operation lever 15 capable of operating a push button 17 of a gas spring 14 is assembled.

In the both-end universal joints 72 being three link members, the upper end portion is attached to be suspended down from the upper connection hole 75 of the suspension board 71, and the lower end portion is connected to the swing board 73. The both-end universal joints 72 includes a joint main body 76 extending in the up-down direction, an upper connection unit 77 pivotally attached at the upper end of the joint main body 76, the upper connection unit being further pivotally attached onto the suspension board 71, and a lower connection unit 78 pivotally attached at the bottom end of the joint main body 76, the lower connection unit being further pivotally attached onto the swing board 73. Further, in the three both-end universal joints 72 being link members, a distance between the lower connection units 78 provided at the lower end is set to be shorter than a distance between the upper connection units 77 provided at the upper end. Here, in the modification, the direction in which the joint main body 76 is pivotally attached onto the upper and lower connection unit 77 and 78, and the direction in which the upper and lower connection unit 77 and 78 are pivotally attached onto the suspension board 71 and the swing board 73 are at right angles in planar view to each other. Thus, the both-end universal joints 72 according to the modification may smoothly operate in all directions in planar view. That is, similarly to the first embodiment, the above-described both-end universal joint 72 corresponds to a non-directional connection unit.

The swing board 73 is a board-like shape of a triangular annular shape in planar view around the leg supporting post 13 suspended and supported onto the suspension board 71 via the both-end universal joints 72 and includes a lower connection hole 79 configured to connect to the lower connection unit 78 provided at the lower end of the both-end universal joints 72 at three locations on the outer circumference surface.

The backrest and seat attaching part 74A is provided at the two locations on front and rear sides on the top surface of the swing board 73 across the suspension board 71 in front-rear direction. Further, a seat attaching part 74B configured to attach the seat receiver 31 operably is disposed over the location from the center to the front end in front-rear direction of the backrest and seat attaching part 74A and a backrest attaching part 74C configured to attach the backrest 4 is disposed on the rear side.

With respect to an operation of the seat 3 in the present modification, similarly to the above-described embodiments, when the seat 3 operates from the reference position (S) into any direction, a center-of-gravity movement mechanism P or a return-force generation mechanism configured to elevate the position of the center of gravity G of the seat surface 3*a* from the reference position (S) is realized by the both-end universal joint 72. In addition, also in the present modification, in the both-end universal joints 72, a distance between the lower connection units 78 provided at the lower end is set to be shorter than a distance between the upper connection units 77 provided at the upper end. As a result of which the both-end universal joint 72 also serves a role of the seat inclining mechanism Q.

As described above, also in the modification of the embodiment, it is also possible to accomplish the operation and effect similar to those in each of the above-described embodiments.

In particular, in the modification, the backrest and seat attaching part 74A configured to attach the seat 3 and the backrest 4 independently is provided and thus, in addition to a flexible operation similar to that in the above-described embodiments, the seat 3 and the backrest 4 can perform an operation with high followability in accordance with the posture of the seated person, allowing the sitting feeling of the seated person to be further improved.

Thus, an embodiment of the present invention has been described, and a specific configuration of each unit is not limited to that in the embodiments described above and various modifications are possible without departing from the gist of the present invention.

For example, in the above-described embodiments, only a mode in which the backrest is provided integrally with the seat is disclosed; however, naturally, a mode in which the backrest is provided separately from the seat, and a mode in which while the seat and the backrest are provided separately, a synchro-tilt mechanism in which the backrest may operate in response to the operation of the seat are provided may also be acceptable. In particular, when the backrest is provided in the seat, it is possible to obtain the synchro-tilt mechanism with a simple configuration.

Further, a bending function of bending the front portion of the seat may be provided, and in association with the front-rear support unit, the seat may be supported at three locations in the front-rear direction.

Further, although an elbow is not disclosed in each of the embodiments described above, of course, provision of the elbow shall not be precluded in each of the embodiments described above. In particular, in a case of a chair directly or indirectly provided with the elbow in the rotation support mechanism, the elbow does not operate forward, rearward, rightward, and leftward in conjunction with the operation of the seat, and thus, a further sense of safety can be given to the seated person.

In addition, all of the embodiments described above disclose the center-of-gravity movement mechanism P as the configuration of the return-force generation mechanism, and naturally, provision of an elastic means such as a spring shall not be precluded as long as it is configured to return the seat to the reference position.

Further, a "buffer means" configured to buffer a bumping feeling upon reaching the operation end of the seat may be provided between the seat or the backrest, and the support mechanism, or within the support mechanism. Specific examples include a buffer member provided either in a contact unit provided on the bottom surface side of the seat or on a unit to be contacted provided on an outer wall of the support mechanism, and an elastic member being provided at the end of the guide holes in the support mechanism and coming in contact with a follower.

Further, in each of the above-described embodiments, the seat is held at the reference position by exclusively using its own weight of the seat; however, a "reference position holding means" may be provided so that any reference position can be set. A specific example may include a balancer, provided in the seat, for adjusting a position of the center of gravity of the seat. Further, a lock means configured to lock the seat at the reference position when the seated person does not sit and to unlock the seat when the seated person sits may be provided as a part of the support mechanism. With such a means, the seated person may easily sit on the seat at the reference position while suppressing undesirable swinging of the seat before sitting, and the seated person may obtain a desirable sitting comfort as a result of being unlocked by sitting.

In addition, it is possible to apply various modifications to another detailed configuration such as a specific shape or material of the seat without departing from the gist of the present invention.

INDUSTRIAL APPLICABILITY

The present invention can be applied to a chair suitably applicable to an office rotating chair and the like.

DESCRIPTION OF REFERENCE NUMERALS

1 Leg
12 Caster
16 Rotation support mechanism
14 Lifting up and down mechanism (gas spring)
3 Seat
7 Support mechanism (suspension support mechanism)
72 Omnidirectional connection unit (both-end universal joint)
8 Support mechanism (guide support mechanism)
82 Omnidirectional connection unit (sliding contact follower)
83 Omnidirectional connection unit (guide curved surface)
G Center of gravity
P Return-force generation mechanism (center-of-gravity movement mechanism)
Q Seat inclining function (seat inclining mechanism)
S Reference position

The invention claimed is:

1. A chair comprising: a leg erected on a floor surface;
a seat arranged in a predetermined reference position above the leg; and
a support mechanism interposed between the leg and the seat, wherein
the support mechanism is arranged below the seat, and is configured to movably support the seat along a predetermined trajectory, the support mechanism comprises:
an omnidirectional connection unit configured to operably connect the seat to the leg such that the seat moves from the predetermined reference position in a moving direction including the front-rear direction and the left-right direction with respect to the leg; and
a seat inclining function configured to downwardly incline a tip side towards the movement direction of the seat; and
a return-force generation mechanism configured to generate, by elevating a center of gravity of the seat in accordance with the operation of the seat from the predetermined reference position, in accordance with an amount of movement, a return force in a direction of returning the seat to the predetermined reference position.

2. The chair according to claim 1, wherein the leg comprises a lifting and lowering mechanism, the seat is arranged above the lifting and lowering mechanism, and the support mechanism is interposed between the lifting and lowering mechanism and the seat.

3. The chair according to claim 2, wherein a rotation support mechanism configured to rotatably support the seat in a horizontal direction relative to the leg is provided.

4. The chair according to claim 3, wherein the omnidirectional connection unit is configured to connect by suspending the seat from the leg.

5. The chair according to claim 4, wherein the omnidirectional connection unit is configured as a link member having a universal joint structure extending in the up-down direction of which the both ends are supported pivotably in the directions including a front-rear direction and a left-right direction.

6. The chair according to claim 5, wherein a plurality of the link members are arranged at a position surrounding the center of the seat in planar view.

7. The chair according to claim 1, wherein a rotation support mechanism configured to rotatably support the seat in a horizontal direction relative to the leg is provided.

8. The chair according to claim 1, wherein the omnidirectional connection unit is configured to connect by suspending the seat from the leg.

9. The chair according to claim 8, wherein the omnidirectional connection unit is configured as a link member having a universal joint structure extending in the up-down direction of which the both ends are supported pivotably in the directions including a front-rear direction and a left-right direction.

10. The chair according to claim 9, wherein a plurality of the link members are arranged at a position surrounding the center of the seat in planar view.

11. The chair according to claim 9, wherein the number of the link members provided is three.

12. The chair according to claim 1, wherein the omnidirectional connection unit includes a guide surface formed along the predetermined trajectory and a follower configured to perform a relative operation following the guide surface.

13. The chair according to claim 12, wherein a rotation support mechanism configured to rotatably support the seat in a horizontal direction relative to the leg is provided, wherein the guide surface is integrally formed, and the support mechanism and the rotation support mechanism are integrally configured by configuring a plurality of followers so as to operate in any directions including front-rear and left-right direction along the guide surface.

14. The chair according to claim 13, wherein the support mechanism has a plurality of the followers and the guide surface is set so that there are always, of the plurality of the followers, at least one follower ascending and at least one another follower descending, during the operation of the seat.

15. The chair according to claim 13, wherein the guide surface has a substantially conical shape.

16. The chair according to claim 13, wherein the follower contacts the guide surface at three or more locations.

17. The chair according to claim 1, wherein the leg includes a caster configured to rollably contact a floor surface.

18. A seat support mechanism, wherein the support mechanism comprises an omnidirectional connection unit configured to connect to a leg while supporting the bottom surface of a seat operably in a moving direction including the front-rear direction and the left-right direction; is configured to draw a trajectory along which a tip side towards the movement direction of the seat is downwardly inclined in accordance with the movement of the supporting location of the seat; and further comprises a return-force generation mechanism configured to generate, by elevating the center of gravity of the seat, in accordance with the amount of movement, the return force in the direction of returning the supporting locations of the seat having moved from a reference position in the directions including the front-rear or left-right direction, to the reference position.

19. The seat support mechanism according to claim 18, wherein the omnidirectional connection unit is configured as a link member having a universal joint structure extending in the up-down direction of which the both ends are supported pivotably in the directions including a front-rear direction and a left-right direction.

20. The seat support mechanism according to claim 19, wherein a plurality of the link members are arranged at a position surrounding the center of the seat in planar view.

* * * * *